US011260450B2

(12) United States Patent
Lee

(10) Patent No.: US 11,260,450 B2
(45) Date of Patent: Mar. 1, 2022

(54) CASTING SLIDING GATE

(71) Applicant: POSCO, Pohang-si (KR)

(72) Inventor: Young Ju Lee, Ulsan (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 16/635,807

(22) PCT Filed: Dec. 22, 2017

(86) PCT No.: PCT/KR2017/015332
§ 371 (c)(1),
(2) Date: Jan. 31, 2020

(87) PCT Pub. No.: WO2019/027109
PCT Pub. Date: Feb. 7, 2019

(65) Prior Publication Data

US 2020/0376543 A1 Dec. 3, 2020

(30) Foreign Application Priority Data

Aug. 2, 2017 (KR) ..... 10-2017-0098128

(51) Int. Cl.
*B22D 41/24* (2006.01)
*B22D 41/32* (2006.01)

(52) U.S. Cl.
CPC ..... *B22D 41/24* (2013.01); *B22D 41/32* (2013.01)

(58) Field of Classification Search
CPC ..... B22D 41/24; B22D 41/32
See application file for complete search history.

(56) References Cited

U.S. PATENT DOCUMENTS

| | | | | | |
|---|---|---|---|---|---|
| 4,321,035 | A * | 3/1982 | Takashima | B22D 7/102 | 432/250 |
| 4,623,130 | A | 11/1986 | Bruckner et al. | | |
| 4,911,338 | A * | 3/1990 | Winkelmann | B22D 41/28 | 222/600 |
| 5,215,666 | A * | 6/1993 | Kuszyk | B22D 41/32 | 222/591 |
| 5,958,279 | A * | 9/1999 | Kawamura | B22D 41/28 | 222/600 |
| 2020/0376543 | A1* | 12/2020 | Lee | B22D 41/32 | |

FOREIGN PATENT DOCUMENTS

| | | |
|---|---|---|
| CN | 86100725 | 9/1986 |
| CN | 2438530 | 7/2001 |
| CN | 1525893 | 9/2004 |
| JP | H09110540 | 4/1997 |
| JP | 11104813 | 4/1999 |
| JP | 2003181626 | 7/2003 |
| JP | 2012055948 | 3/2012 |

(Continued)

OTHER PUBLICATIONS

International Search Report—PCT/KR2017/015332 dated May 28, 2018.

(Continued)

*Primary Examiner* — Scott R Kastler
(74) *Attorney, Agent, or Firm* — Cantor Colburn LLP

(57) ABSTRACT

Provided is a casting sliding gate including a plurality of plates, and at least a portion of the plates includes carbon fibers and carbide and is capable of suppressing damage due to a thermal shock.

8 Claims, 5 Drawing Sheets

(56) References Cited

FOREIGN PATENT DOCUMENTS

| | | |
|---|---|---|
| JP | 2012121049 | 6/2012 |
| KR | 19890004798 | 5/1989 |
| KR | 100263249 | 9/2000 |
| KR | 20040110892 | 12/2004 |
| KR | 101010638 | 1/2011 |
| KR | 101532671 | 6/2015 |

OTHER PUBLICATIONS

PCT Written Opinion—PCT/KR2017/015332 dated May 28, 2018, citing KR 10-0263249 and KR 10-1989-0004798.
European Search Report—European Application No. 17919965.8 dated Mar. 18, 2020, citing U.S. Pat. No. 4,623,130 and KR 100263249.
Chinese Office Action—Chinese Application No. 201780093604.7 dated Mar. 2, 2021, citing JP H09-110540, JP 5705519, CN 1032423, CN 86100725, CN 1525893, CN 2438530, U.S. Pat. No. 4,623,130, and KR 93-0023090.
Japanese Office Action—Japanese Application No. 2020-504366 dated Feb. 2, 2021, citing JP 09-110540 and JP 2012-121049.

* cited by examiner

CASTING SLIDING GATE

CROSS-REFERENCE TO RELATED APPLICATIONS

This application is a national entry of PCT Application No. PCT/KR2017/015332 filed on Dec. 22, 2017, which claims priority to and the benefit of Korean Application No. 10-2017-0098128 filed Aug. 2, 2017, in the Korean Patent Office, the entire contents of which are incorporated herein by reference.

TECHNICAL FIELD

The present disclosure relates to a casting sliding gate, and more particularly, to a sliding gate capable of suppressing damage due to thermal shock.

BACKGROUND ART

In general, cast pieces are manufactured while a molten steel received in a mold is cooled through a cooling platform. For example, a continuous casting process is a process in which a molten steel is injected into a mold having a certain internal shape and a cast piece half-solidified inside the mold is continuously drawn to a lower side of the mold, so that various semifinished products such as slabs, blooms, billets, and beam blanks are manufactured.

Such a continuous casting process may be performed by using a continuous casting apparatus including a turndish, a mold, and a secondary cooling platform for cooling and rolling cast pieces. Here, the molten steel received in the turndish may be supplied to the mold through a nozzle assembly provided to a lower portion of the turndish. The nozzle assembly may be configured to include an upper nozzle provided to a lower portion of the turndish so as to discharge the molten steel and an immersing nozzle provided under the upper nozzle. In this case, the amount of the molten steel supplied to a mold may be adjusted through a stopper or a sliding gate.

Among these, for the sliding gate, a three-plate type constituted by an upper plate, a middle plate, and a lower plate may be mainly used. Such a sliding gate has openings formed in respective plates, and overlapping extents between the opening of the middle plate and openings of the upper and lower plates may be adjusted by reciprocating the middle plate between the upper plate and the lower plate. In other words, the amount of molten steel supplied to a mold may be controlled by adjusting the areas of the respective openings formed in the upper plate and the lower plate, the areas being opened by the opening formed in the middle plate.

However, the vicinities of the openings formed in the respective plates are in direct contact with a high-temperature molten steel, and thus, a crack is easily generated by a thermal shock. Accordingly, there is a limitation in that the molten steel flows to the outside along the crack and an operation should be stopped, or the content of inclusions inside the molten steel increases due to inflow of external air through the crack, and thus, the quality of the cast pieces is degraded.

In addition, the plates are integrally formed, and the crack formed in the vicinity of an opening is propagated along the outer peripheral sections of the plates and is formed over the entirety of the plates. Thus, even when a crack is caused at a portion of the plate, the crack may be caused over the entirety of the plate, and therefore the plate should be replaced with a new plate. In general, the plate should be replaced after performing casting three or four times, but when a crack is caused, the plate should be replaced regardless of the number of uses, and thus, it is not desirable in terms of productivity and cost reduction.

RELATED ART DOCUMENTS (Prior art document 1) KR2004-0110892 A
(Prior art document 2) JP2003-181626 A

DISCLOSURE OF THE INVENTION

Technical Problem

The present disclosure provides a casting sliding gate capable of improving the service life by suppressing damage due to a thermal shock.

The present disclosure also provides a casting sliding gate in which at least a portion of a plate

Technical Solution

In accordance with an exemplary embodiment, a sting sliding gate includes a plurality of plates, wherein at least a portion of the plates comprises carbon fibers and carbide The plates may each include an opening used as a movement path of a molten steel, and at least the vicinity of the opening comprises carbon fibers and carbide.

The plates may each include an inner body having the opening formed therein and an outer body disposed on an outside of the inner body, and at least a portion of the inner body may include carbon fibers and carbide.

The inner body may be inserted into and fixed to the outer body in a detachable manner, and the inner body may be fixed to the outer body by self weight.

The outer body may include an $Al_2O_3$—$ZrO_3$—$SiO_2$—C-based refractory material.

The inner body may include a first body having the opening formed therein and a second body which is disposed to an outside of the first body, and at least the second body may include carbon fibers and carbide.

The first body may be inserted into and coupled to the second body, and the second body may be inserted and coupled to the outer body.

The casting sliding gate may include 40-50 wt % of the carbon fibers and 50-60 wt % of the carbide with respect to a total of 100 wt % of the carbon fibers and carbide.

The carbon fibers may be aligned so as to extend in at least any one direction among the lengthwise direction, width direction and height direction of the inner body inside the inner body.

The carbon fibers may be formed in lengths of 0.5-1.5 cm, and the carbon fibers may be distributed to the inner body.

Advantageous Effects

A casting sliding gate in accordance with an exemplary embodiment is formed so that only a damaged portion of a plate can be replaced, and thus, the service life of the plate is improved, and costs that may be consumed for replacing the entirety of the plate may be saved. That is, the vicinity of the opening that may easily be damaged due to a thermal shock may be formed by using a structure including carbon fibers and carbide which are strong against a thermal shock. At this point, the structure is replaceably connected to a refractory material, and thus, a crack caused in the vicinity of the opening may be prevented from being propagated to an outer peripheral portion, and when a crack is caused in the structure, the structure can be selectively replaced. Thus, when crack is caused, only a portion having the crack formed therein can be selectively replaced without replacing the entirety of the plate, and thus, costs consumed to replace the plates may be reduced.

BRIEF DESCRIPTION OF THE DRAWINGS

Exemplary embodiments can be understood in more detail from the following description taken in conjunction with the accompanying drawings, in which.

MODE FOR CARRYING OUT THE INVENTION

Figure 1:
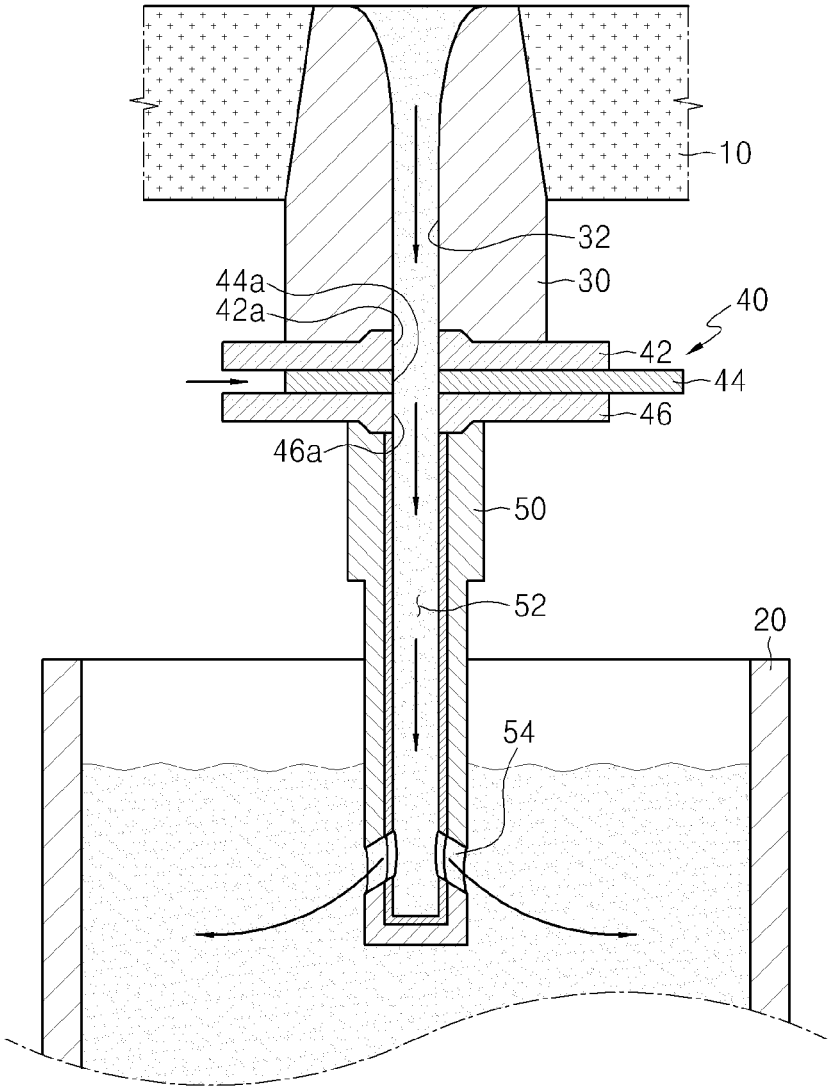
FIG. 1 is a schematic view illustrating a casting machine in accordance with a related art.

Hereinafter exemplary embodiments will be described in more detail with reference to the accompanying drawings. However, the present invention may be embodied in different forms and should not be construed as limited to the embodiments set forth herein. Rather, these embodiments are provided so that this disclosure will be thorough and complete, and will fully convey the scope of the present invention to those skilled in the art. In descriptions, like reference numeral refer to like configuration, figures may be partially exaggerated for clarity of illustration of exemplary embodiments, and like reference numerals refer to like elements in figures.

FIG. 1 is a schematic view illustrating a casing machine in accordance with a related art.

First, the configuration of a casting machine will be described with reference to FIG. 1.

The casting machine includes: a turndish 10 for receiving a molten steel; and a mold 20 which is provided under the turndish 10 and firstly cools the molten steel supplied from the turndish 10 to manufacture a slab. In addition, although not shown, the casting machine includes a secondary cooling platform (not shown) which is provided under a mold 20 and cools and rolls the slab drawn from the mold 20.

A nozzle assembly for supplying the molten steel to the mold may be provide under the turndish 10. The nozzle assembly may include: an upper nozzle 30 connected to a lower portion of the turndish 10; and an immersing nozzle 50 connected to a lower portion of the upper nozzle 30. The immersing nozzle 50 is provided so that an upper portion thereof is connected to the lower portion of the upper nozzle 30 and extends to the mold 20 side, and the lower side of the immersing nozzle is immersed into the molten steel inside the mold 20. The immersing nozzle 50 may have therein an inner hole part 52 used as a movement path of the molten steel, and have, in a lower portion thereof, a discharge port 54 for discharging the molten steel to the mold 20. In addition, the immersing nozzle 50 may have, in the inner hole part (not shown) thereof, a coating layer (not shown) having excellent heat resistance and corrosion resistance, and have, on the outside thereof, a slag line part (not shown). In addition, a sliding gate 40 for adjusting the amount of molten steel supplied to the mold may be provided in a connection portion of the upper nozzle 30 and the immersing nozzle 50.

The sliding gate 40 may include: an upper plate 42; a lower plate 46 provided under the upper plate 42; and a middle plate 44 provided between the upper plate 42 and the lower plate 46. At this point, the middle plate 44 may be movably disposed between the upper plate 42 and the lower plate 46.

A first opening 42*a*, a second opening 44*a*, and a third opening 46*a* which are used as the movement path of the molten steel may respectively be formed in the upper plate 42, the middle plate 44, and the lower plate 46. The first opening 42*a* and the third opening 46*a* may be disposed under a position communicating with a flow passage 32 formed in the upper nozzle 30, that is, under the flow passage 32. In addition, the middle plate 44 may overlap the second opening 44*a* with the first opening 42*a* and the third opening 46*a* or cause the second opening 44*a* to avoid the first opening 42*a* and the third opening 46*a* while moving between the upper plate 42 and the lower plate 46. Accordingly, a communication path is formed by linking the first opening 42*a*, the second opening 44*a*, and the third opening 46*a*, so that the molten steel can be discharged, or be prevented from being discharged by disconnecting the first opening 42*a* and the third opening 46*a*.

When the communication path of the sliding gate 40 is opened, the molten steel may move along the communication path and be injected into the mold 20 via the immersing nozzle 50. At this point, the vicinities of the first opening 442*a*, the second opening 44*a*, and the third opening 46*a* come into direct contact with the molten steel. During casting, cracks may be caused in the vicinities of the respective openings 42*a*, 44*a*, and 46*a* while continuously contacting the high-temperature molten steel. In addition, the cracks caused in the vicinities of the respective openings 42*a*, 44*a*, and 46*a* may propagate to the outer side as the casting progresses and be formed over the entirety of the plates. In this case, external air flows into the molten steel through the cracks, the molten steel is oxidized, or inclusions in the molten steel are much generated and may thus degrade the quality of slab, and in a severe case, a large-scale accident may be caused in which the plates are damaged and the molten steel flows to the outside. Accordingly, when a crack is caused in the vicinity of the openings, replacement with a new plate is being performed in order to prevent the occurrence of such limitations. However, even when a crack is formed in a local portion of the plates, the entirety of the plates should be replaced, and thus, there is a limitation in that remarkable costs are consumed to replace the plates, and costs are required to treat the plates in which the crack has been caused.

Thus, in the present disclosure, the occurrence of cracks may be suppressed by including carbon fibers and carbide, which are strong against thermal shock, in at least a portion of the plates to mitigate the thermal shock due to the contact with the molten steel. In addition, at least a portion of the plates are formed to be separable, so that the costs consumed to replace the plates may be reduced.

Figure 2:
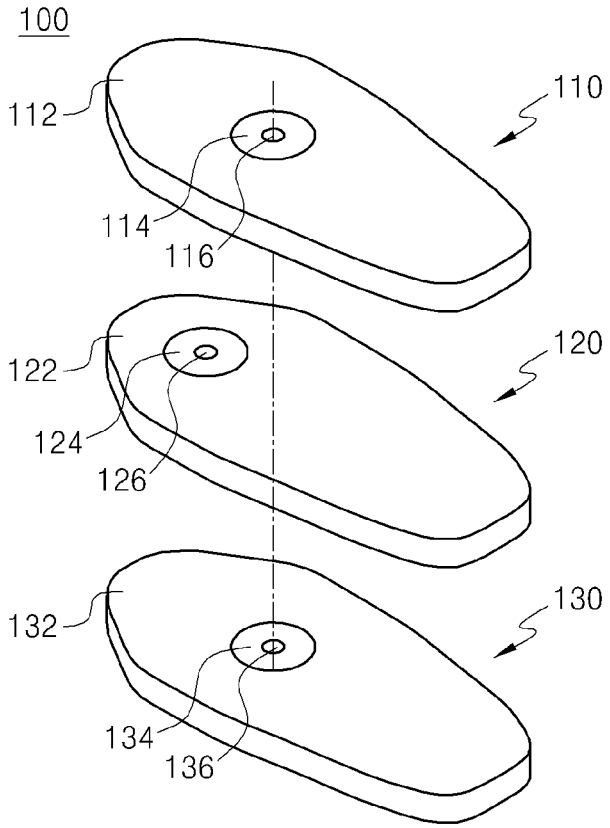
FIG. 2 is an exploded perspective view of a sliding gate in accordance with an exemplary embodiment.
Figure 3:
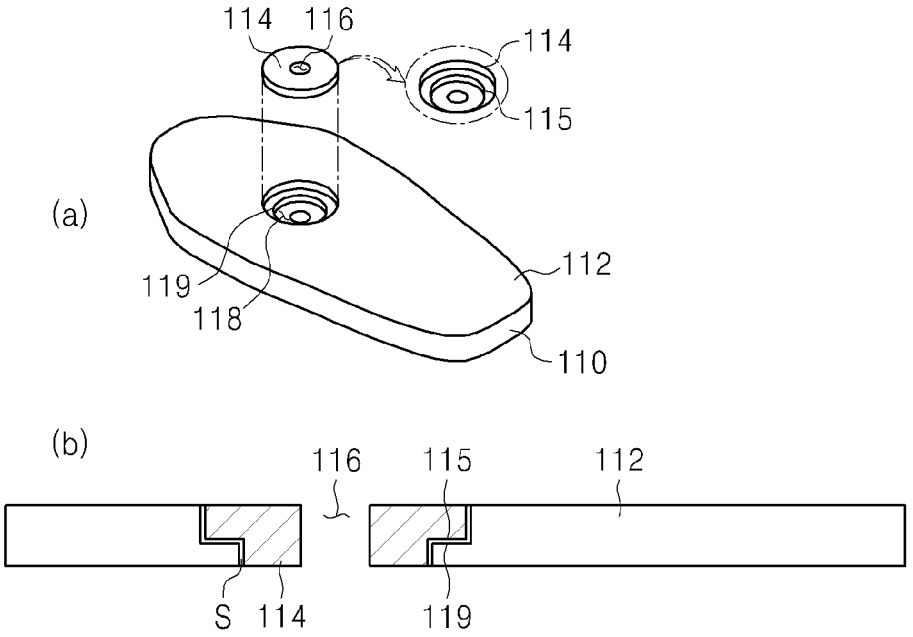
FIG. 3 is a cross-sectional view of any one among the plates constituting a sliding gate in accordance with an exemplary embodiment.
Figure 4:
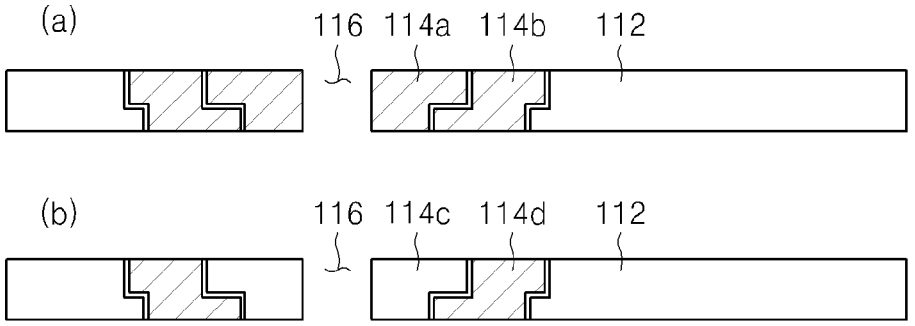
FIG. 4 is a cross-sectional view illustrating a modified example of a plate.

FIG. 2 is an exploded perspective view of a sliding gate in accordance with an exemplary embodiment, FIG. 3 is a cross-sectional view of any one among the plates constituting a sliding gate in accordance with an exemplary embodiment, and FIG. 4 is a cross-sectional view illustrating a modified example of a plate.

The present disclosure relates to a casting sliding gate including a plurality of plates, and at least a portion of the plates may include carbon fibers and carbide.

Referring to FIGS. 2 and 3, a sliding gate 100 in accordance with an exemplary embodiment may include an upper plate 110, a lower plate 130, and a middle plate 120. One or more of the plates 110, 120 and 130 may include: inner bodies 114, 124 and 134 having respective openings 116, 126 and 136 formed therein; and outer bodies 112, 122, and 132 provided outside the respective inner bodies 114, 124 and 134, and at least the inner bodies 114, 124 and 134 may contain carbon fibers and carbide in at least a portion thereof. In addition, the inner bodies 114, 124 and 134 may be detachably coupled to the respective outer bodies 112, 122 and 132. Here, the plates 110, 120 and 130 are described to be separable, but the entirety of the plates may be formed to contain carbon fibers and carbide, or only the vicinities of the openings may be formed to selectively contain carbon fibers and carbide.

The upper plate 110, the lower plate 130 and the middle plate 120 may all be formed to be separable, and thus will be referred to as the plate 110 instead of the upper plate 110, the lower plate 130 and the middle plate 120. In addition, when describing each of components, the reference symbol is described as the reference symbol corresponding to the upper plate 110.

The plate 110 may include: an inner body 114 in which the opening 116 is formed; and an outer body 112 disposed so as to surround the inner body 114 from the outside of the inner body 114.

At least a portion of the inner body 114 may include carbon fibers and carbide. At this point, the carbon fibers may be contained in an amount of 40-50 wt % and the carbide may be contained in an amount of 50-60 wt % with respect to the total 100 wt % of the carbon fibers and the carbide. Here, the carbon fibers are used to absorb thermal shock and suppress the propagation of a crack, and the carbide functions to couple the carbon fibers between the carbon fibers. Thus, when the carbon fibers are less than the proposed range, it is difficult to suppress the occurrence of a crack, and when more than the proposed range, there is a limitation in that it is difficult to shape the inner body 114 in a desired shape. In addition, when the carbide is less than the proposed range, the coupling between the carbon fibers is reduced, and much voids occur between the carbon fibers and the strength of the inner body 114 may be degraded, and when less than the proposed range, there is a limitation in that the content of carbon fibers is relatively reduced and it is difficult to suppress the occurrence of a crack and the propagation of the crack.

Since the carbon fibers have directionality, thermal shock occurring in the inner body 114 may be distributed or branch in the lengthwise direction of the carbon fibers. In addition, the carbon fibers have toughness, and thus have characteristic of not being easily damaged and absorbing thermal shock. The carbon fibers may absorb and distribute thermal shock occurring in the inner body 114 and suppress or prevent the propagation of the thermal shock to the outer body 112.

The carbon fibers may be aligned so as to extend in at least any one direction among the lengthwise direction, the width direction, and the height direction of the inner body 114. Alternatively, the carbon fibers may be cut into a length of approximately 0.5-1.5 cm and be uniformly distributed and arranged over the entirety of the inner body 114.

The inner body 114 may have, in the center portion thereof, an opening 116 used as a movement path of the molten steel. The inner body 114 may be formed in an approximately ring shape.

The outer body 112 may include a refractory material generally used to manufacture the plate 110. The outer body 112 may be formed so as to contain an $Al_2O_3$—$ZrO_3$—$SiO_2$—C-based refractory material.

The outer body 112 may have an insertion opening 128 formed to insert the inner body 114. The insertion opening 128 may be formed so as to pass through the outer body 112 in the vertical direction.

The inner body 114 may be inserted into the outer body 112 in a detachable manner. At this point, the inner body 114 is a portion coming into direct contact with the molten steel, and a crack may easily be caused, and therefore be inserted into the outer body 112 so as to be easily replaced.

The inner body 114 may be coupled in an insertion type so as to be fixed to the outer body 112 by a self weight.

Referring to FIG. 3, steps 115 and 119 may respectively be formed on the outer circumferential surface of the inner body 114 and the inner circumferential surface of the outer body 112 so as to engage with each other. The inner body 114 and the outer body 112 are not connected through a separate adhesion, and the inner body 114 may be inserted into the outer body 112 and fixed by the self weight of the inner body. Thus, the step 119 formed in the outer body 112 may be formed in a shape that can support the inner body 114. As illustrated in FIG. 3, the steps 115 and 119 may be formed in a step shape, but a concave curved surface is formed on the outer circumferential surface of the inner body 114, and a convex curved surface is formed on the inner circumferential surface of the outer body 112, and thus, the inner body 114 may also be allowed to be stably inserted into the outer body 112.

In addition, when the inner body 114 is inserted into the outer body 112, a space S may also be formed between the inner body 114 and the outer body 112. This is because the inner body 114 and the outer body 113 are thermally expanded in an actual operation at a temperature of approximately 1,000-1,500° C., a crack is formed in the inner body 114 and the outer body 112 and the inner body 114 and the outer body 112 may be damaged. The space S formed as such may be filled by the thermal expansion of the inner body 114 and the outer body 112 during operation.

In addition, when the temperature descends after operation, the inner body 114 or the outer body 112 is contracted and a space S is formed, and thus, the inner body 114 may easily be detached from the outer body 112.

Meanwhile, the inner body 114 may be formed in an integral type as illustrated in FIG. 4, but may be formed in a separable type as illustrated in FIG. 4. The inner body 114 may include first bodies 114*a* and 114*c* in which the opening 116 is formed; and second bodies 114*b* and 114*d* provided outside the first bodies 114*a* and 114*c*. At this point, the first bodies 114*a* and 114*c* and the second bodies 114*b* and 114*d* may be detachably coupled in an insertion type as described above.

Referring to (a) of FIG. 4, the first body 114*a* coming into direct contact with the molten steel may be formed so as to contain carbon fibers and carbide. The second body 114*b* provided between the first body 114*a* and the outer body 112 may also be formed of the same material as the first body 114*a*. As such, when the first body 114*a* and the second body 114*b* are formed to contain carbon fibers and carbide, the propagation of a crack may be prevented or reduced at the connection portion between the first body 114*a* and the second body 114*b*, and thus, the propagation of the crack to the outer body 112 may efficiently be prevented.

Referring to (b) of FIG. 4, the first body 114*c* may be formed of the same material as the outer body 112 and the second body 114*d* may be formed to contain carbon fibers and carbide. As such, when the second body 114*d* is formed to contain carbon fibers and carbide, the propagation of a crack may be prevented or mitigated by the second body 114*d* even when the crack is caused in the first body 114*c*, and thus, the propagation of the crack caused in the first body 114*c* to the outer body 112 may be prevented or reduced. In addition, since only the first body 114*c*, in which a crack is easily caused, is required to be selectively replaced, there is a merit in that costs may be reduced by reducing a replacement area.

Through this configuration, occurrence of cracks is suppressed by mitigating thermal shock due to a molten steel and the propagation of the crack to the outer body 112 may be suppressed or prevented. In addition, only the region in which a crack easily occurs is formed so as to be partially replaceable, so that the replacement costs and costs for treating wastes may be reduced.

Hereinafter, test results for examining heat resistance characteristics of a sliding gate in accordance with an exemplary embodiment will be described.

Figure 5:
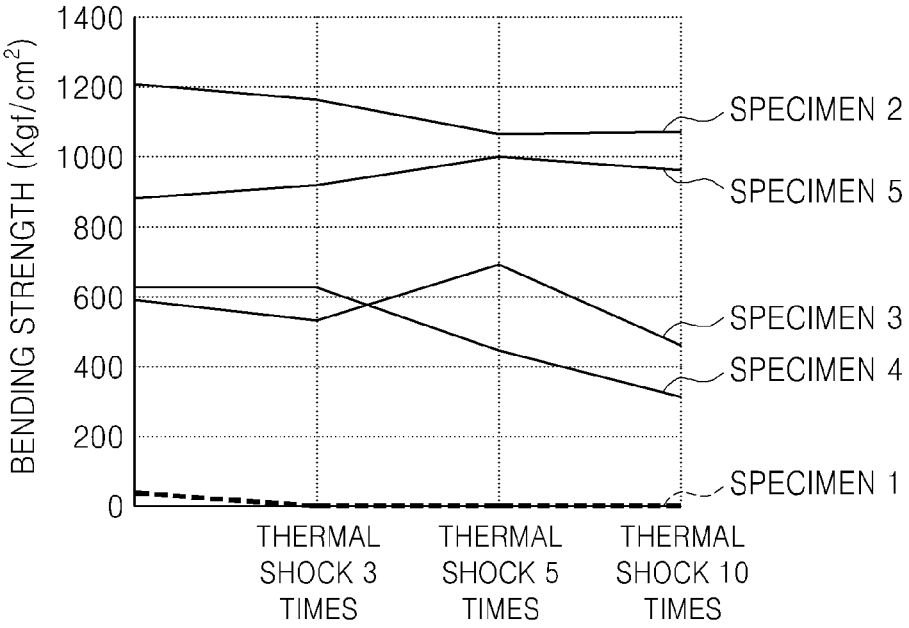
FIG. 5 is a graph illustrating measured results of the bending strength of an existing refractory material and a structure in accordance with an exemplary embodiment after a thermal shock.
Figure 6:
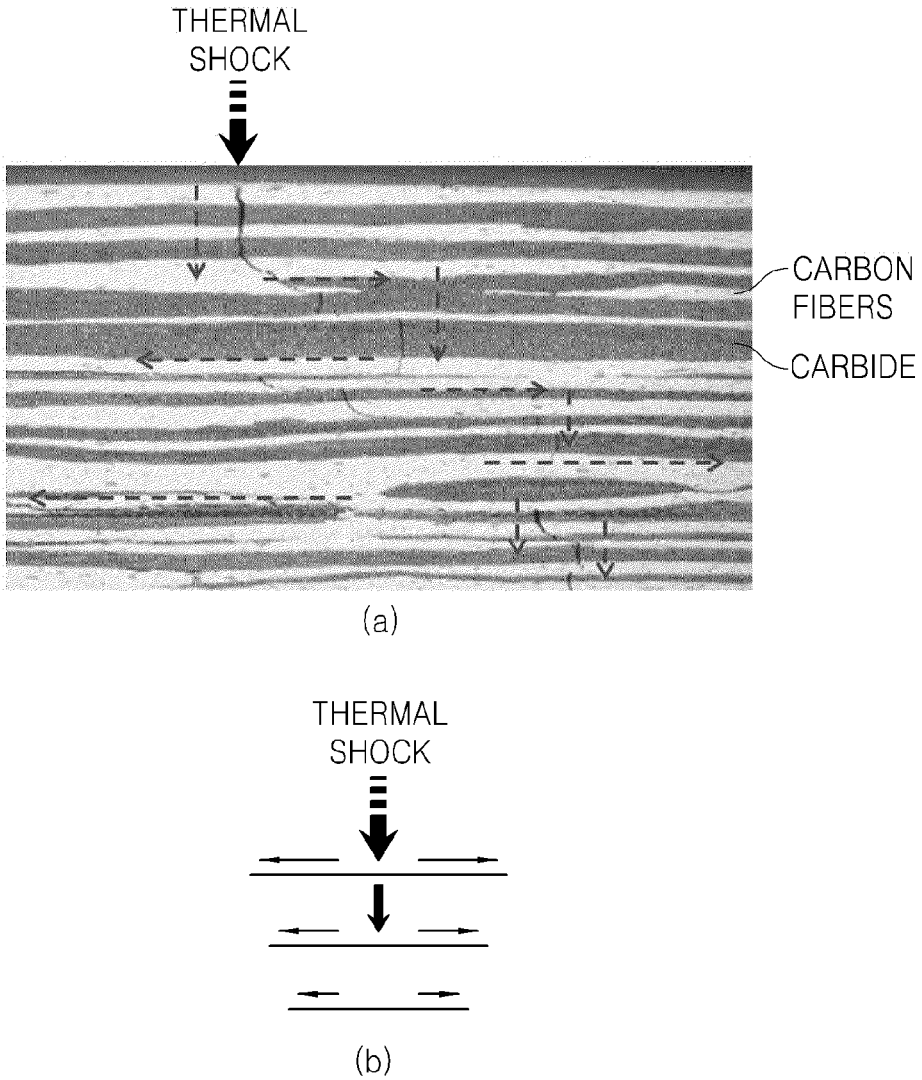
FIG. 6 is a view illustrating a propagated state of a crack in a structure in accordance with an exemplary embodiment.

FIG. 5 is a graph illustrating measured results of bending strength of an existing refractory material and a structure in accordance with an exemplary embodiment after a thermal shock, and FIG. 6 is a view illustrating a propagated state of a crack in a structure in accordance with an exemplary embodiment.

<Specimen Manufacturing>

Five types of specimens were manufactured for test. At this point, the specimens were manufactured so as to have the same shapes and sizes and formed in cuboidal shapes.

Specimen 1 was manufactured by using an $Al_2O_3$—$ZrO_3$—$SiO_2$—C-based refractory material generally used as a plate of a sliding gate.

Specimen 2 was manufactured so as to include 40 wt % of carbon fibers and 60 wt % of carbide with respect to the total 100 wt %. Specimen 2 was manufactured by means of an impregnation type in which carbon fibers were aligned so as to extend in the lengthwise direction of a container, for example, in the lengthwise direction of specimen 2, liquid-state silicon was injected, and then, powder-state carbon powder was added. In this procedure, carbide (SiC) could be generated by the reaction of silicon and carbon. Here, an example in which carbon fibers extend in the lengthwise direction of the specimen will be described, and the carbon fibers may be aligned so as to extend in the width direction of the specimen and also be aligned so as to extend in the thickness or height direction of the specimen. Alternatively, the carbon fibers may also be aligned so as to be aligned in various directions in the specimen.

Specimen 3 was manufactured by using 100 wt % of carbon fibers. Specimen 3 was manufactured by aligning carbon fibers in a container in the lengthwise direction of the container and then pressing the carbon fibers.

Specimen 4 was manufactured by the same method as specimen 1 and was then heat-treated.

Specimen 5 was manufactured so as to include 40 wt % of carbon fibers and 60 wt % of carbide with respect to the total 100 wt %. At this point, specimen 5 was manufactured by the same method as specimen 1 except for using carbon fibers cut in lengths of 0.5-1.5 cm. In specimen 5, carbon fibers may be disposed to be uniformly distributed, and are not aligned in a specific direction.

<Room Temperature Strength Measurement>

The room temperature strengths of specimens 1 to 5 were measured at a temperature of approximately 25° C. using a three-point bending strength test method. The results are illustrated in Table 1 below.

<Strength Measurement after Thermal Shock>

Specimens 1 to 5 were put into a heating furnace and heated to 1,450° C., and specimens 1 to 5 were taken out from the heating furnace, put into a cooling water of 20-25° C., and maintained for 3 minutes. This procedure was repeatedly performed 3 times, 5 times, and 10 times, and then the strength was measured by using the three-point bending strength test method. The results are illustrated in FIG. 5 and Table 1 below.

TABLE 1

| | | Specimen 1 | Specimen 2 | Specimen 3 | Specimen 4 | Specimen 5 |
|---|---|---|---|---|---|---|
| Room temperature strength (kgf/cm$^2$) | | 106.15 | 1208.55 | 594.36 | 626.92 | 881.54 |
| Strength after thermal shock (kgf/cm$^2$) | 3 times | 38.10 (Once) | 1165.60 | 531.30 | 627.08 | 921.65 |
| | 5 times | — | 1064.33 | 691.87 | 445.22 | 995.13 |
| | 10 times | — | 1070.79 | 463.14 | 315.06 | 964.26 |
| Strength degrading rate after thermal shock (%) | 3 times | 64.1 | 3.6 | 10.6 | 0 | −4.5 |
| | 5 times | — | 11.9 | −16.4 | 29.0 | −12.9 |
| | 10 times | — | 11.4 | 22.1 | 49.7 | −9.4 |

Examining Table 1, it may be found that specimen 1 manufactured by using an $Al_2O_3$—$ZrO_3$—$SiO_2$—C-based refractory material has remarkably a low room temperature strength compared to specimens 2 to 5 that contain carbon fibers. In addition, specimen 1 was very weak thermal shock characteristics, and was damaged to an extent of being almost unusable after performing a thermal shock test once.

Conversely, it could be found that specimens 2 to 5 that contain carbon fibers has a higher strength than specimen 1 after performing thermal shock tests 10 times.

Referring to FIG. 5 and Table 1, the strengths of specimens 2, 3 and 4 were mostly degraded after the thermal shock test, but exhibited higher strengths than specimen 1. In particular, the strength of specimen 5 was rather higher after the thermal shock test. It is estimated that this is because silicon and carbon fibers are sintered into carbide by heat while reacting with each other. That is, it is estimated that in case of specimen 5, since carbon fibers were cut in short lengths and used, the surface area of the carbon fibers increased and the contact area with carbide increased, and thus, the coupling between the carbon fibers and carbide increased.

In addition, the degrading rate of specimen 2 was the smallest among the specimens 2, 3, 4 and 5. However, specimen 3 manufactured by using only carbon fibers has a lower strength degrading rate than specimen 4, but the variation in the strength degrading rate is irregular, and thus, it is determined that specimen 3 is not suitable to be applied to a plate.

In addition, thermal shock tests were performed on specimens 2 to 5, and then, the surface states of the specimens were observed before measuring the strengths. Consequently, it could be confirmed that specimens mostly maintained initial shapes and no crack occurred in the surfaces thereof.

Through such results, it could be confirmed that when the inner body of a plate was manufactured by suing carbon fibers and carbide, the occurrence of a crack due to thermal shock could be suppressed or prevented.

This is because carbon fibers has directionality and toughness, and when a thermal shock occurs, the thermal shock can be absorbed while being transferred in the lengthwise direction of the carbon fibers. As illustrated in FIG. 6, when a thermal shock occurs in a specific portion, the thermal shock is distributed along carbon fibers and may be gradually reduced along the propagation direction of the thermal shock. Thus, the transfer of the thermal shock from the inner body to the outer body may be suppressed and prevented.

In addition, even when a crack occurs, the crack may mostly dissipate from the inner body without being propagated to the outer body by the above-described principle. Thus, the replacement term of the inner body may be increased, and thus, a decrease in productivity caused by an operation stop due to the replacement of the plates may be suppressed, and the costs consumed for the plate replacement may be saved. In addition, the degradation in the quality of slab may be suppressed or prevented during casting by suppressing the occurrence of a crack due to thermal shock and preventing inflow of external air into molten steel.

So far, preferred embodiments have been described in more detail with reference to the accompanying drawings. However, the present invention is not limited to the embodiments described above, and those skilled in the art to which the present invention belongs would understand that various modification and other equivalent embodiments can be made without departing from the subject matters of the present invention. Hence, the protective scope of the present invention shall be determined by the technical scope of the accompanying claims.

INDUSTRIAL APPLICABILITY

A casting sliding gate in accordance with an exemplary embodiment is formed so that only a damaged portion of a plate can be replaced, and thus, the service life of the plate is improved, and costs that may be consumed by replacing the entirety of the plate may be saved.

What is claimed is:

1. A casting sliding gate comprising: a plurality of plates, wherein each of the plates comprises an inner body having an opening formed therein and an outer body disposed outside of the inner body, the opening forming a movement path of molten steel, the inner body, which directly contacts the molten steel, comprises carbon fibers and carbide, and the outer body comprises an $Al_2O_3$—$ZrO_3$—$SiO_2$—C-based refractory material, and the inner body comprises 40-50 wt % of the carbon fibers and 50-60 wt % of the carbide with respect to a total weight of the inner body.

2. The casting sliding gate of claim 1, wherein the carbon fibers are aligned inside the inner body so as to extend in at least one direction among a lengthwise direction, a width direction and a height direction of the inner body, or wherein the carbon fibers have a length of 0.5-1.5 cm and are distributed inside the inner body.

3. The casting sliding gate of claim 1, wherein the inner body is inserted into and fixed to the outer body in a detachable manner, and the inner body is fixed to the outer body by self weight.

4. A casting sliding gate comprising: a plurality of plates, wherein each of the plates comprises an inner body having an opening formed therein and an outer body disposed outside of the inner body, the opening forming a movement path of molten steel, the outer body comprises an $Al_2O_3$—$ZrO_3$—$SiO_2$—C-based refractory material, and the inner body comprises a first body having the opening and a second body disposed between the first body and the outer body, at least the second body comprises carbon fibers and carbide to prevent a crack from being propagated to the outer body, and the second body comprises 40-50 wt % of the carbon fibers and 50-60 wt % of the carbide with respect to a total weight of the second body.

5. The casting sliding gate of claim 4, wherein the first body is inserted into and coupled to the second body, and the second body is inserted into and coupled to the outer body.

6. The casting sliding gate of claim 4, wherein the inner body and the outer body are coupled in a detachable matter, and a space is formed between the inner body and the outer body.

7. The casting sliding gate of claim 4, wherein the carbon fibers are aligned inside the second body so as to extend in at least one direction among a lengthwise direction, a width direction and a height direction of the second body.

8. The casting sliding gate of claim 4, wherein the carbon fibers have a length of 0.5-1.5 cm, and are distributed inside the second body.

* * * * *